US009332814B2

(12) United States Patent
Brock

(10) Patent No.: US 9,332,814 B2
(45) Date of Patent: May 10, 2016

(54) COMPACT ORGANIZER FOR COSMETICS

(71) Applicant: Barbara Brock, New York, NY (US)

(72) Inventor: Barbara Brock, New York, NY (US)

( * ) Notice: Subject to any disclaimer, the term of this patent is extended or adjusted under 35 U.S.C. 154(b) by 0 days.

(21) Appl. No.: 14/211,926

(22) Filed: Mar. 14, 2014

(65) Prior Publication Data

US 2014/0261533 A1 Sep. 18, 2014

Related U.S. Application Data

(60) Provisional application No. 61/793,672, filed on Mar. 15, 2013.

(51) Int. Cl.
*A45C 11/00* (2006.01)
*A45D 40/22* (2006.01)
*A45C 15/04* (2006.01)

(52) U.S. Cl.
CPC ..... *A45C 11/008* (2013.01); *A45C 15/04* (2013.01); *A45D 40/22* (2013.01); *A45D 40/222* (2013.01)

(58) Field of Classification Search
CPC ..... A45C 11/008; A45C 13/02; A45C 2001/086; A45D 33/006; A45D 33/008; A45D 33/18; A45D 33/22; A45D 33/24; A45D 33/26; A45D 40/22; A45D 40/221; A45D 40/222; A45D 40/24; A45D 5/005; A45D 25/10; A45D 43/14; A45D 43/16; A45D 43/163; A45D 43/164; A45D 43/169; A45D 43/22; A45D 43/24; A45D 73/005; E05D 3/122; E05Y 2201/722
USPC ..... 132/294, 301, 310, 312; 206/581
See application file for complete search history.

(56) References Cited

U.S. PATENT DOCUMENTS 1,341,775 A * 6/1920 Bowers ..... E05F 15/619 49/340
1,352,759 A * 9/1920 Markert ..... B65D 5/5014 206/486
1,370,294 A * 3/1921 Dumons ..... A45D 33/006 206/37
1,489,788 A * 4/1924 Reid ..... A45D 33/22 132/296
1,499,361 A * 7/1924 Freund ..... A45C 15/04 132/315
1,541,451 A * 6/1925 Wallace ..... A45D 33/006 132/296
1,652,771 A * 12/1927 Deubel ..... A45C 5/005 126/229
1,667,564 A * 4/1928 Pearson ..... A45C 5/005 206/581
1,741,741 A * 12/1929 Sherman ..... B65D 85/327 206/521.9
1,752,948 A * 4/1930 Herrmann ..... A45C 13/02 132/287
1,795,396 A * 3/1931 Holter ..... A45C 11/008 132/315
1,809,523 A * 6/1931 McLean ..... B65D 7/26 206/0.8
1,897,522 A * 2/1933 Lewis ..... A45D 33/006 132/293
1,940,485 A * 12/1933 Beeman ..... E05F 15/67 49/200
1,947,604 A * 2/1934 Lewis ..... A45D 29/20 132/315
1,957,383 A * 5/1934 Book ..... B65D 43/24 190/23
1,973,283 A * 9/1934 Buttrick ..... A45C 5/005 190/111
1,999,328 A * 4/1935 Lessard ..... A45D 33/22 132/315
2,005,415 A * 6/1935 Ebner ..... B65D 5/326 206/521.1
2,023,886 A * 12/1935 Hoffman ..... B65D 7/26 206/509
2,030,979 A * 2/1936 Fuller ..... B65D 5/446 206/521.15
2,062,237 A * 11/1936 Schwartz ..... A45C 11/008 132/314

(Continued)

*Primary Examiner* — Rachel Steitz
*Assistant Examiner* — Jennifer Gill
(74) *Attorney, Agent, or Firm* — Miskin & Tsui-Yip, LLP; Gloria Tsui-Yip

(57) ABSTRACT

A compact, modular, cosmetic organizer that provides portability and ease of use and access to the cosmetics. The cosmetic organizer includes a housing, a tray, a plurality of foldable modular boxes, and a foldable mirror. The modular boxes and mirror are collapsible for storage within the housing. When in use, the modular boxes rest within the tray to allow easy access to the cosmetics.

13 Claims, 13 Drawing Sheets

(56) References Cited

U.S. PATENT DOCUMENTS 2,078,557 A * 4/1937 Bjorkman ..... A45C 5/005 190/109
2,108,551 A * 2/1938 Royal ..... A45D 33/006 132/307
2,116,513 A * 5/1938 Frankenstein ..... B65D 5/2009 206/521
2,143,062 A * 1/1939 Ericson ..... A45C 11/008 190/109
2,145,462 A * 1/1939 Speck ..... A45C 15/04 132/288
2,154,235 A * 4/1939 Esterow ..... A45C 13/103 132/301
2,167,926 A * 8/1939 Glasker ..... A45C 11/008 132/315
2,205,118 A * 6/1940 Friedman ..... A45C 7/0031 190/104
2,224,995 A * 12/1940 Vogel ..... A45D 33/008 132/304
2,247,320 A * 6/1941 Stanley ..... A45C 11/008 150/114
2,296,080 A * 9/1942 Arrowood ..... A45C 3/00 206/287.1
2,299,673 A * 10/1942 Zolkind ..... A45C 3/00 132/312
2,339,474 A * 1/1944 Hardin ..... B65D 25/02 217/19
2,359,100 A * 9/1944 Florin ..... A45C 11/008 110/104 R
2,525,838 A * 10/1950 Smith ..... B65D 9/18 206/511
2,549,643 A * 4/1951 Siegal ..... A45D 33/008 132/302
2,553,607 A * 5/1951 Rosenberg ..... B65D 7/26 206/509
2,556,066 A * 6/1951 Cline ..... A45C 11/008 190/111
2,558,126 A * 6/1951 Davenport ..... B65D 7/26 206/511
2,643,814 A * 6/1953 Bradley ..... B65D 5/5007 206/418
2,671,584 A * 3/1954 Taylor, Jr. ..... B65D 71/0033 206/216
2,675,936 A * 4/1954 Ridge ..... B65D 19/16 108/56.3
2,720,884 A * 10/1955 Fritz ..... A45D 40/221 132/297
2,761,458 A * 9/1956 Werber ..... A45C 13/06 132/297
2,770,387 A * 11/1956 Loween ..... A45D 33/26 132/297
2,841,306 A * 7/1958 Vitoux ..... B65D 11/1833 190/19
2,866,467 A * 12/1958 Bradford ..... A45D 33/006 132/303
2,877,689 A * 3/1959 Pribis ..... F41A 23/00 206/317
2,925,210 A * 2/1960 Fallert ..... B65D 5/02 206/386
2,931,114 A * 4/1960 Peterson ..... B60R 7/05 224/312
2,952,379 A * 9/1960 Potter ..... B65D 88/522 206/509
2,990,054 A * 6/1961 Gellman ..... A45D 33/22 206/37
3,185,379 A * 5/1965 Kohlhaas ..... B65D 5/326 206/599
3,186,585 A * 6/1965 Denny ..... B65D 7/26 206/511
3,374,499 A * 3/1968 Horstman ..... E05D 3/122 16/273
3,374,914 A * 3/1968 Adam ..... B65D 11/1873 217/12 R
3,397,706 A * 8/1968 Hogan ..... A45D 29/20 132/312
3,422,487 A * 1/1969 Dickinson ..... E05D 3/06 16/273
3,442,414 A * 5/1969 Pierre ..... A45D 33/006 132/301
3,446,215 A * 5/1969 Howe ..... A45D 44/02 132/294
3,450,293 A * 6/1969 Goudeau ..... B65D 11/1873 220/4.28
3,491,681 A * 1/1970 Quinlan ..... B65D 25/02 100/34
3,552,466 A * 1/1971 Fairchilds ..... B65D 90/02 206/386
3,565,244 A * 2/1971 Wakefield ..... B65D 5/603 206/218
3,572,577 A * 3/1971 Dorfman ..... B65D 5/0015 206/509
3,637,278 A * 1/1972 Easterbrooks ..... A45D 40/22 132/294
3,650,459 A * 3/1972 Tucker ..... B65D 19/20 206/591
3,675,808 A * 7/1972 Brink ..... B65D 1/225 206/509
3,710,900 A * 1/1973 Fink ..... A45C 13/02 190/110
3,767,037 A * 10/1973 Anderson ..... B65D 5/02 206/497
3,828,966 A * 8/1974 Martin ..... A47J 36/022 220/495.03
3,861,582 A * 1/1975 Bock ..... B65D 5/6661 206/807
3,911,936 A * 10/1975 Kingsford ..... A45D 33/006 132/301
3,949,929 A * 4/1976 Kupersmit ..... B65D 19/20 108/55.1
4,019,634 A * 4/1977 Bonnot ..... B65D 19/06 108/53.3
4,065,877 A * 1/1978 Kelley ..... A01G 9/104 206/423
4,119,107 A * 10/1978 Pinzone ..... A45C 5/00 132/316
4,126,265 A * 11/1978 Holmes ..... B65D 5/006 206/509
4,127,228 A * 11/1978 Hall ..... B65D 5/2047 206/205
4,234,080 A * 11/1980 Gellert ..... G07D 9/004 206/0.82
4,250,938 A * 2/1981 Siegel ..... A45C 13/02 150/111
4,331,231 A * 5/1982 Boyle ..... B65D 5/5206 206/45.25
4,335,830 A * 6/1982 Garganese ..... B65D 5/56 206/805
4,356,952 A * 11/1982 Rekow ..... B65D 5/0035 206/511
4,371,077 A * 2/1983 Solitt ..... A47F 7/03 206/458
4,421,127 A * 12/1983 Geer ..... A45D 33/006 132/294
4,453,471 A * 6/1984 Harrington ..... B65D 9/24 108/55.1
4,454,889 A * 6/1984 Contreras, Sr. ..... A45C 11/22 132/301
4,469,226 A * 9/1984 Matney ..... B65D 75/366 206/461
4,474,196 A * 10/1984 Yuhara ..... A45C 13/10 132/301
4,491,231 A * 1/1985 Heggeland ..... B65D 21/02 206/509
4,508,237 A * 4/1985 Kreeger ..... B65D 11/182 206/509
4,548,824 A * 10/1985 Mitchell ..... B65D 21/08 206/497
4,548,852 A * 10/1985 Mitchell ..... B65D 21/08 206/497
4,589,430 A * 5/1986 Sussman ..... A45D 40/22 132/218
4,602,715 A * 7/1986 Sarver ..... B65D 81/05 206/515

(56) References Cited

U.S. PATENT DOCUMENTS 4,606,461 A * 8/1986 Bolton, Sr. ..... B65D 19/20 206/600
4,609,116 A * 9/1986 Simms ..... B65D 9/12 206/600
4,674,520 A * 6/1987 Gretshel ..... A45D 33/00 132/286
4,681,127 A * 7/1987 Gueret ..... A45D 40/22 132/301
4,733,806 A * 3/1988 Sloop ..... A45F 3/02 206/316.2
4,765,027 A * 8/1988 Andric ..... E05D 3/122 16/354
4,765,252 A * 8/1988 Shuert ..... B65D 15/22 108/55.1
4,781,300 A * 11/1988 Long ..... D06F 95/002 220/6
4,807,773 A * 2/1989 Tsai ..... A45D 33/24 132/296
4,809,851 A * 3/1989 Oestreich, Jr. ..... B65D 7/32 206/511
4,826,014 A * 5/1989 Schefer ..... A45D 33/22 132/294
4,872,550 A * 10/1989 Stranges ..... A63F 9/001 206/315.1
4,884,680 A * 12/1989 Israel ..... A45D 40/0087 206/1.9
4,889,254 A * 12/1989 Vola ..... A45C 7/0045 132/294
4,999,879 A * 3/1991 Baer ..... E05D 3/122 16/273
5,005,697 A * 4/1991 Jimbo ..... A45C 13/02 132/294
5,025,928 A * 6/1991 Orosy ..... A45C 11/008 206/581
5,044,537 A * 9/1991 Bufalo ..... A45F 3/04 220/4.27
5,092,354 A * 3/1992 Pacelli, Jr. ..... A45D 40/22 132/294
5,114,006 A * 5/1992 Wilk ..... B65D 81/36 206/349
5,123,540 A * 6/1992 Karavias ..... A45C 7/0036 206/541
5,181,612 A * 1/1993 Liu ..... A45C 7/0036 206/542
5,215,248 A * 6/1993 Moser ..... B65D 5/326 206/600
5,237,838 A * 8/1993 Merritt-Munson .. A45C 11/008 383/110
5,250,000 A * 10/1993 Boutin ..... A63F 3/0023 206/315.1
5,301,872 A * 4/1994 Tusing ..... B65D 19/20 206/600
5,329,947 A * 7/1994 Shikler ..... A45C 11/008 132/291
5,361,603 A * 11/1994 Merritt-Munson .. A45C 11/008 220/592.25
5,447,215 A * 9/1995 Volkmar ..... A45C 3/02 190/109
5,452,803 A * 9/1995 Stromberg ..... B65D 21/0235 206/503
5,469,961 A * 11/1995 Chang ..... F16K 41/12 206/307
5,564,599 A * 10/1996 Barber ..... B65D 77/061 206/600
5,588,549 A * 12/1996 Furtner ..... B65D 11/1833 220/4.28
5,595,305 A * 1/1997 Hart ..... B65D 19/12 206/600
5,605,167 A * 2/1997 Montoli ..... A45C 13/02 132/293
5,699,926 A * 12/1997 Jacques ..... B65D 11/1833 206/199
5,706,935 A * 1/1998 Lorton ..... A45C 11/008 150/117
5,713,471 A * 2/1998 Gueret ..... A45D 40/22 132/294
5,762,246 A * 6/1998 Drew ..... B60R 7/088 206/308.1
5,788,350 A * 8/1998 Fladung ..... A63H 33/04 312/244
5,813,420 A * 9/1998 Sussman ..... A45D 33/006 132/294
5,819,764 A * 10/1998 Sussman ..... A45C 13/008 132/293
5,829,595 A * 11/1998 Brown ..... B65D 19/0018 206/386
5,832,941 A * 11/1998 Murillo ..... A45C 5/005 132/294
5,875,794 A * 3/1999 Ekman ..... A45C 5/005 132/287
5,879,769 A * 3/1999 Greenland ..... A45D 40/0087 206/461
5,897,209 A * 4/1999 Roegner ..... A45C 3/00 150/113
5,909,738 A * 6/1999 Quennessen ..... A45C 13/008 132/293
5,915,545 A * 6/1999 Shackel ..... A45C 13/02 206/5
5,931,169 A * 8/1999 Kervoalen ..... A45D 33/008 132/294
5,944,188 A * 8/1999 Grosskopf ..... A45D 40/0087 206/460
5,950,639 A * 9/1999 Suzuki ..... A45C 13/008 132/294
5,966,777 A * 10/1999 Jantschek ..... E04B 2/7431 16/354
5,991,975 A * 11/1999 Baer ..... E05D 7/009 16/250
6,002,651 A * 12/1999 Baccaray ..... A45D 33/006 132/294
6,006,918 A * 12/1999 Hart ..... B65D 19/12 206/600
6,032,815 A * 3/2000 Elstone ..... B65D 25/38 206/600
6,050,410 A * 4/2000 Quirion ..... B65D 19/20 206/386
6,055,776 A * 5/2000 Dettling ..... E05F 15/619 296/56
6,062,234 A * 5/2000 Finocchiaro ..... A45D 33/00 132/294
6,135,287 A * 10/2000 Hartwall ..... B65D 19/18 206/600
6,138,686 A * 10/2000 Yuhara ..... A45C 13/008 132/293
6,164,451 A * 12/2000 Sherman ..... A45C 11/24 206/472
6,170,689 B1 * 1/2001 Flesher ..... B65D 19/06 206/508
6,189,698 B1 * 2/2001 Asser ..... A45C 11/008 132/314
6,202,852 B1 * 3/2001 Jones ..... A45D 33/006 132/293
6,206,530 B1 * 3/2001 Eberts ..... A45D 42/08 359/879
6,244,400 B1 * 6/2001 Bowers ..... A45C 3/02 150/111
6,267,277 B1 * 7/2001 Taylor ..... A45C 7/0095 206/350
6,283,298 B1 * 9/2001 Seidler ..... A45C 13/008 206/581
6,311,701 B1 * 11/2001 Yuhara ..... A45C 13/008 132/294
6,371,131 B1 * 4/2002 Finocchiaro ..... A45D 29/20 132/294
6,532,970 B2 * 3/2003 Phue ..... A45C 1/04 132/293
6,554,001 B1 * 4/2003 Godshaw ..... A45D 42/04 132/312
6,595,604 B1 * 7/2003 Peterson ..... A01K 97/06 190/110
6,631,806 B2 * 10/2003 Jackson ..... A45C 11/008 206/457
6,644,710 B2 * 11/2003 Seel ..... B60R 7/02 224/497

(56) References Cited

U.S. PATENT DOCUMENTS 6,681,936 B2 * 1/2004 Godshaw ..... A45C 5/005 132/312
6,766,907 B2 * 7/2004 Jackson ..... A45C 11/008 206/457
6,805,254 B2 * 10/2004 Tanzer ..... B65D 19/06 220/4.29
6,926,192 B1 * 8/2005 Dowd ..... B65D 5/3621 229/117
6,955,390 B2 * 10/2005 Rigorth ..... E05F 15/63 296/146.4
7,004,323 B1 * 2/2006 Symonds ..... A45C 13/02 206/542
7,025,220 B2 * 4/2006 Verespej ..... B65D 83/0805 206/233
7,047,983 B2 * 5/2006 Manougian ..... A45D 40/22 132/294
D549,968 S * 9/2007 Pitot ..... D6/312
7,314,051 B2 * 1/2008 Yuhara ..... A45D 33/006 132/294
7,316,235 B2 * 1/2008 Maio ..... A45D 40/24 132/293
7,353,831 B1 * 4/2008 Forsline ..... A45D 33/00 132/294
7,359,287 B2 * 4/2008 Baroche ..... A45D 33/30 132/294
7,406,748 B2 * 8/2008 Baer ..... E05D 3/022 16/354
7,422,018 B2 * 9/2008 Dieudonat ..... A45D 40/221 132/294
7,451,887 B2 * 11/2008 Kobayashi ..... A45D 33/006 132/294
D599,551 S * 9/2009 Beavers ..... D3/304
7,621,401 B2 * 11/2009 Alegre de Miquel ..... A47K 10/421 206/233
7,726,502 B2 * 6/2010 Apps ..... B65D 21/0224 220/4.28
D625,930 S * 10/2010 Merica ..... D6/312
7,963,397 B2 * 6/2011 Seagle ..... B65D 19/18 206/600
8,066,137 B2 * 11/2011 Sanfilippo ..... B65B 1/06 220/6
8,109,402 B2 * 2/2012 Hartwall ..... B65D 19/18 206/600
8,276,599 B2 * 10/2012 Gindi ..... A45D 33/008 132/294
8,322,354 B2 * 12/2012 Parker ..... A45D 33/20 132/287
8,424,542 B1 * 4/2013 Han ..... A45C 11/00 132/212
8,631,956 B2 * 1/2014 Dowd ..... B65D 11/1846 206/503
2002/0023855 A1 * 2/2002 Cho ..... A45C 13/02 206/373
2002/0096409 A1 * 7/2002 Roegner ..... A45C 3/00 190/109
2002/0125091 A1 * 9/2002 Krulik ..... A45C 3/02 190/114
2002/0126920 A1 * 9/2002 Mogil ..... A45C 7/0077 383/110
2002/0157912 A1 * 10/2002 Godshaw ..... A45C 5/005 190/102
2002/0162567 A1 * 11/2002 Jang ..... A45D 33/26 132/294
2003/0019502 A1 * 1/2003 Terzian ..... A45D 33/24 132/294
2003/0098256 A1 * 5/2003 Lu ..... B65D 11/1833 206/511
2003/0106563 A1 * 6/2003 Raisner ..... A45C 11/008 132/200
2003/0132228 A1 * 7/2003 Apps ..... B65D 11/1833 220/6
2003/0132234 A1 * 7/2003 Hirose ..... B60R 7/04 220/830
2003/0150769 A1 * 8/2003 Lau ..... B65D 88/005 206/600
2003/0159403 A1 * 8/2003 Verespej ..... B65D 83/0805 53/412
2003/0177607 A1 * 9/2003 Pelletier ..... E05D 3/122 16/354
2003/0183240 A1 * 10/2003 Manougian ..... A45D 40/22 132/295
2003/0209462 A1 * 11/2003 Godshaw ..... A45C 5/005 206/581
2003/0213723 A1 * 11/2003 Lombardi ..... A45D 33/003 206/581
2003/0221924 A1 * 12/2003 Tong ..... A45C 7/0036 190/107
2004/0112895 A1 * 6/2004 Bartasevich, Jr. . B29C 45/14336 220/4.28
2004/0159659 A1 * 8/2004 Rumpel ..... B65D 11/1833 220/7
2004/0178197 A1 * 9/2004 Hsu ..... B65D 11/1833 220/7
2004/0200438 A1 * 10/2004 Jeffrey ..... A01K 27/006 119/858
2004/0251163 A1 * 12/2004 Conde ..... B65D 83/0805 206/494
2005/0045510 A1 * 3/2005 Marks ..... A45C 13/02 206/373
2005/0189367 A1 * 9/2005 Chasid ..... B65D 75/5838 221/35
2006/0027481 A1 * 2/2006 Gelardi ..... A45D 33/008 206/581
2006/0042993 A1 * 3/2006 Tuhkru ..... A45C 11/008 206/581
2006/0060481 A1 * 3/2006 Hartman ..... B65D 73/0078 206/305
2006/0077654 A1 * 4/2006 Krieger ..... A45D 33/008 362/136
2006/0196744 A1 * 9/2006 Greiner ..... A45C 13/02 190/110
2006/0207697 A1 * 9/2006 Greiner ..... A45C 7/0095 150/113
2006/0237989 A1 * 10/2006 Kuan ..... B62D 25/12 296/76
2006/0291753 A1 * 12/2006 Godshaw ..... A45C 3/00 383/4
2007/0029226 A1 * 2/2007 Yuhara ..... A45D 33/006 206/581
2007/0119734 A1 * 5/2007 Pichahchi ..... A45C 13/02 206/320
2007/0121315 A1 * 5/2007 Lan ..... A45D 33/32 362/135
2007/0131240 A1 * 6/2007 Prague ..... A45D 33/22 132/294
2007/0131568 A1 * 6/2007 Georgia ..... A45C 13/02 206/223
2007/0189932 A1 * 8/2007 Glenn ..... B65D 11/1833 422/400
2007/0246386 A1 * 10/2007 Nykoluk ..... A45C 7/0095 206/320
2007/0246497 A1 * 10/2007 Indeddi ..... A45C 13/02 224/575
2007/0272719 A1 * 11/2007 Laughton ..... A45C 11/38 224/629
2008/0000493 A1 * 1/2008 Anderson ..... A45D 33/006 132/295
2008/0023023 A1 * 1/2008 Boye ..... A45C 11/008 132/294
2008/0121641 A1 * 5/2008 Rankin ..... B65D 25/04 220/507
2008/0276956 A1 * 11/2008 Cho ..... A45D 33/006 132/294
2008/0295930 A1 * 12/2008 Arcese ..... A45C 3/06 150/103
2008/0312054 A1 * 12/2008 Boland ..... B42F 15/007 493/102
2009/0010575 A1 * 1/2009 Sanka ..... A45C 11/00 383/25
2009/0038900 A1 * 2/2009 Redzisz ..... A45C 3/00 190/108

(56) References Cited

U.S. PATENT DOCUMENTS

2009/0039122 A1* 2/2009 Antonioni ..... A45C 13/02 224/250
2009/0044827 A1* 2/2009 Zilber ..... A45D 40/00 132/297
2009/0162506 A1* 6/2009 Weir ..... A47J 47/10 426/396
2009/0166247 A1* 7/2009 Gindi ..... A45D 33/008 206/581
2009/0242554 A1* 10/2009 Robinson ..... B65D 11/1833 220/6
2010/0051048 A1* 3/2010 Wang ..... A45D 40/24 132/296
2010/0089778 A1* 4/2010 Park ..... A45C 7/0095 206/320
2010/0126814 A1* 5/2010 Sternberg ..... A45C 13/02 190/110
2010/0162527 A1* 7/2010 Naukkarinen ..... H04M 1/022 16/386
2010/0230312 A1* 9/2010 Sorrentino ..... B65D 21/0202 206/369
2011/0049196 A1* 3/2011 Sturk ..... B29C 45/1615 222/530
2011/0132508 A1* 6/2011 Castellucci ..... A45C 13/02 150/113
2011/0155752 A1* 6/2011 Ha ..... A45D 33/006 220/755
2011/0253166 A1* 10/2011 Lin ..... A45D 33/025 132/307
2011/0253167 A1* 10/2011 Shteysel ..... A45D 40/24 132/314
2011/0266297 A1* 11/2011 Thorpe ..... B65D 43/166 220/831
2012/0031897 A1* 2/2012 Robinson ..... B65D 11/1833 220/6
2012/0067878 A1* 3/2012 Orgeldinger ..... B65D 11/1833 220/6
2012/0152799 A1* 6/2012 Ficker ..... B65D 19/18 206/600
2012/0247068 A1* 10/2012 Laurita ..... B65D 11/1833 53/458
2012/0318798 A1* 12/2012 Domoy ..... B65D 43/169 220/258.2
2013/0133686 A1* 5/2013 Shteysel ..... A45D 40/24 132/314
2013/0193147 A1* 8/2013 Bouix ..... A45D 33/006 220/495.01
2014/0060713 A1* 3/2014 Barrow, Jr. ..... A45C 11/008 150/134
2014/0084010 A1* 3/2014 Wan ..... A45D 40/24 220/525
2014/0224271 A1* 8/2014 Green ..... A45D 33/22 132/200
2014/0246353 A1* 9/2014 Campagna ..... B65D 19/16 206/600
2014/0251866 A1* 9/2014 Smallman ..... B65D 1/34 206/557
2014/0261530 A1* 9/2014 McNamara ..... A45D 33/008 132/301
2014/0262862 A1* 9/2014 Rothschild ..... A45C 7/0036 206/216
2014/0299151 A1* 10/2014 Stroud ..... A45D 33/008 132/315
2014/0318570 A1* 10/2014 Petry ..... 132/314
2014/0318992 A1* 10/2014 Morelli Carullo ..... B65D 5/327 206/6.1

* cited by examiner

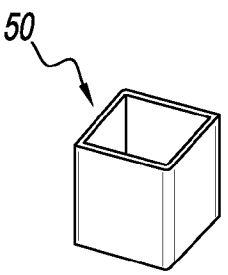
FIG. 4A
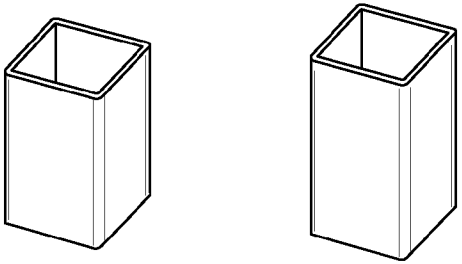
FIG. 4B
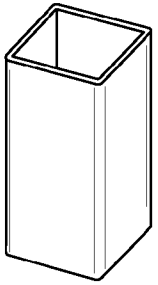
FIG. 4C
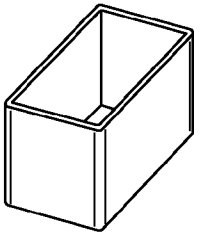
FIG. 4D
FIG. 4E
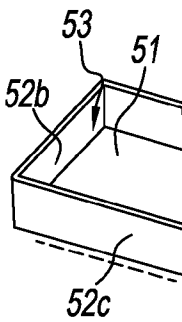
FIG. 4F
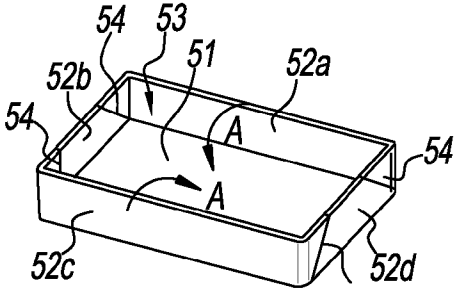
FIG. 4G
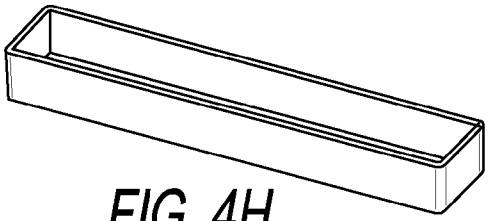
FIG. 4H
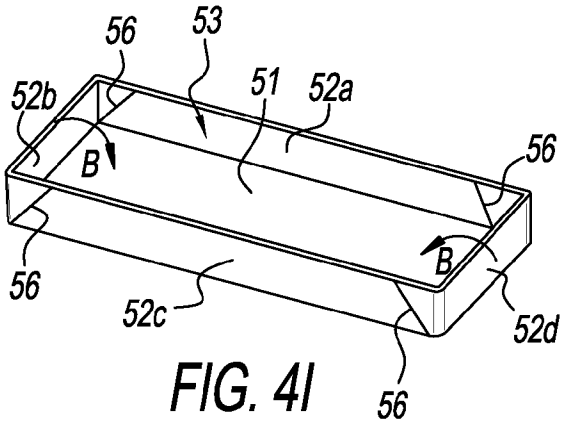
FIG. 4I

COMPACT ORGANIZER FOR COSMETICS

This application claims the benefit of provisional patent application Ser. No. 61/793,672, filed on Mar. 15, 2013, which is hereby incorporated by reference

FIELD OF THE INVENTION

The invention relates to a cosmetic organizer. In particular, a compact, modular, cosmetic organizer that provides portability and ease of use and access to the cosmetics.

BACKGROUND OF THE INVENTION

Cosmetic organizers that are compact and portable are common. An example of such prior art cosmetic organizers includes a small pouch with sleeves and/or zippered pockets. Each sleeve or pocket is designed to hold a particular type of cosmetics. As there are twenty-eight (28) basic cosmetic categories of cosmetics, each having its own specific shape and size, such cosmetic organizer disadvantageously cannot store and keep all the categories of cosmetics organized. Further, when a user seeks to access the cosmetics from such a cosmetic organizer, a user must zip and unzip pockets, slide an item from and into a sleeve, etc., which is not convenient and time consuming. Often, a cosmetic item may be lost towards the bottom of a pocket or inside the pouch.

Other prior art cosmetic organizers that allow easy access of cosmetics and provide storage for all basic cosmetic categories are disadvantageously not compact. An example of such cosmetic organizer is the inventor's U.S. Pat. No. 7,591,382, which is hereby incorporated in its entirety by reference.

Therefore, there is a need for a cosmetic organizer that is compact, modular, portable and yet allows ease of access to the cosmetics when in use.

SUMMARY OF THE INVENTION

The present invention is a cosmetic organizer that is compact, modular, portable and provides ease of access to the cosmetic when in use.

The cosmetic organizer of the present invention comprises a housing, a tray, a plurality of modular boxes, and a mirror. The modular boxes and mirror are collapsible such that they can be stored within the housing, either in the tray or in compartments of the housing.

Cosmetics may be stored in the different compartments of the housing or in additional pouches or bags that may be stored in the tray and within the housing.

BRIEF DESCRIPTION OF THE DRAWINGS

Preferred embodiments of the present invention have been chosen for purposes of illustration and description and are shown in the accompanying drawings forming a part of the specification wherein:

FIGS. 4A-4I are various modular boxes for use with the removable tray of the cosmetic organizer.

DETAILED DESCRIPTION OF THE PREFERRED EMBODIMENTS

Figure 1:
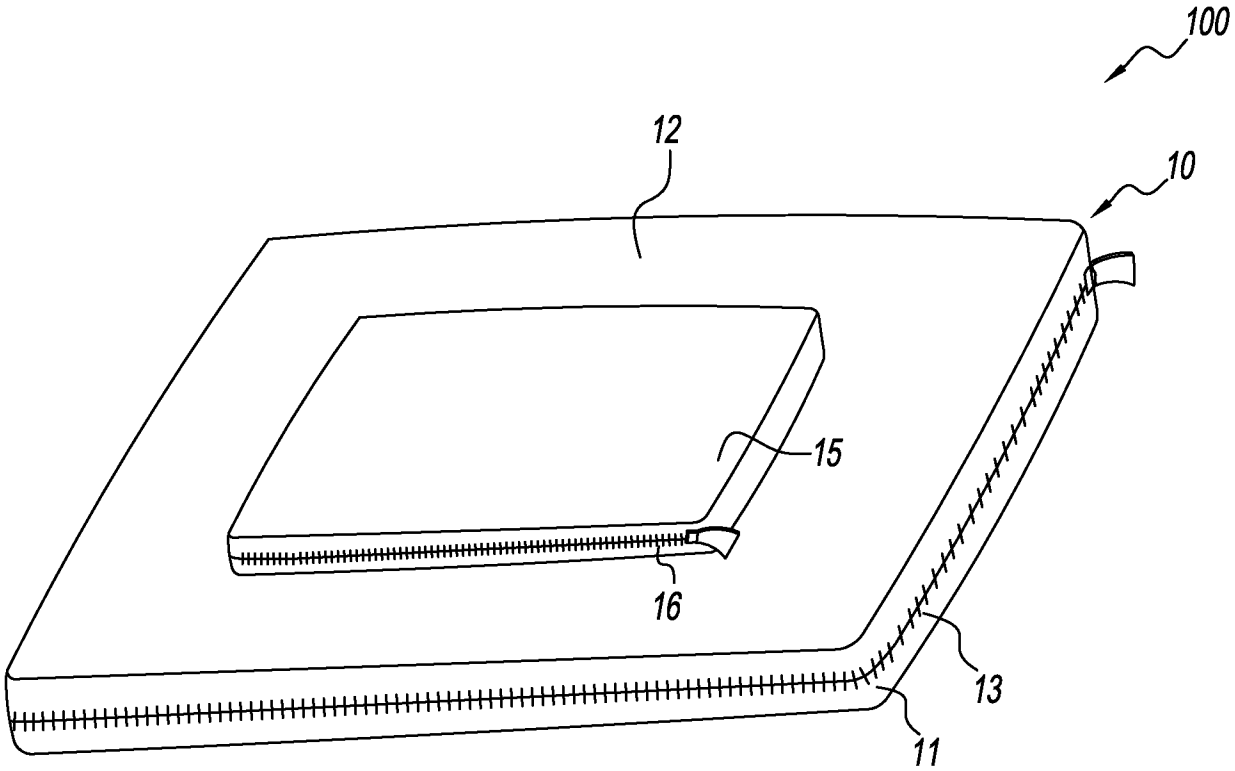
FIG. 1 is the housing of the cosmetic organizer of the present invention in a closed position.

With reference to the drawings, wherein the same reference number indicates the same element throughout, there is shown in FIG. 1 the cosmetic organizer 100 of the present invention in a closed position. As shown in FIGS. 1-4, the cosmetic organizer 100 includes a housing 10, a tray 30, and at least one modular box 50. The tray 30 and modular box 50 are stored within the housing 10 to facilitate portability of the cosmetic organizer 100.

Figure 2:
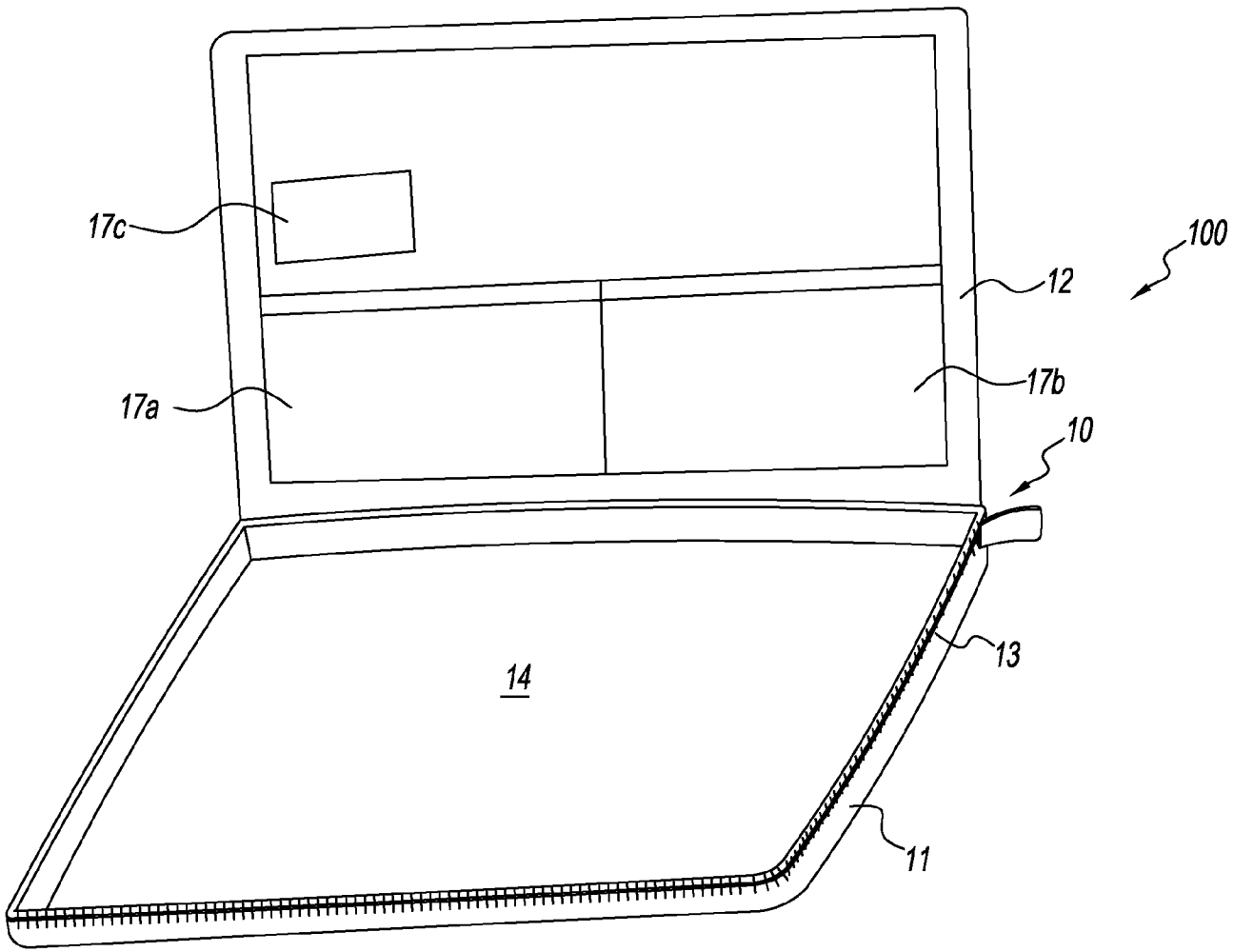
FIG. 2 is the housing of the cosmetic organizer of the present invention in an open position.

As shown in FIGS. 1 and 2, the housing 10 has a rectangular shape, with a base 11 and a cover 12 connected to each other on one side and by a zipper 13 along the remaining three sides of the housing 10. The base 11 defines the main storage compartment 14. On the outer surface of the cover 12 is an additional compartment 15 having a zipper 16. On the inner surface of the cover 12 are additional compartments 17*a*, 17*b*, etc., which may be sleeves for slidably receiving cosmetic item(s). Each of the compartment 14, 15, 17*a*, 17*b*, etc. of the housing 10 can be closeable with a zipper, Velcro® attachments, snap buttons, or other closure means known to one skilled in the art. The compartments 14, 15, 17*a*, 17*b* can be used to store various cosmetic items when cosmetic organizer 100 is closed and not in use. More or less compartments can be provided on both the inner and outer surfaces of the cover 12 or along the inside edges of base 11. Although zipper 13 is shown to be along three sides of the housing 10, it can also be on only one side of the housing 10 with the remaining three sides connected such that the housing 10 acts as a sleeve or it can be on all sides of the housing 10 such that the cover 12 can be completely removed from base 11. The housing 10 is preferably made of a soft material, such as silicone, neoprene, textile, rubber, etc. However, housing 10 can also be made of a hard material such as metal, carbon fiber, plastic, etc.

Figure 3:
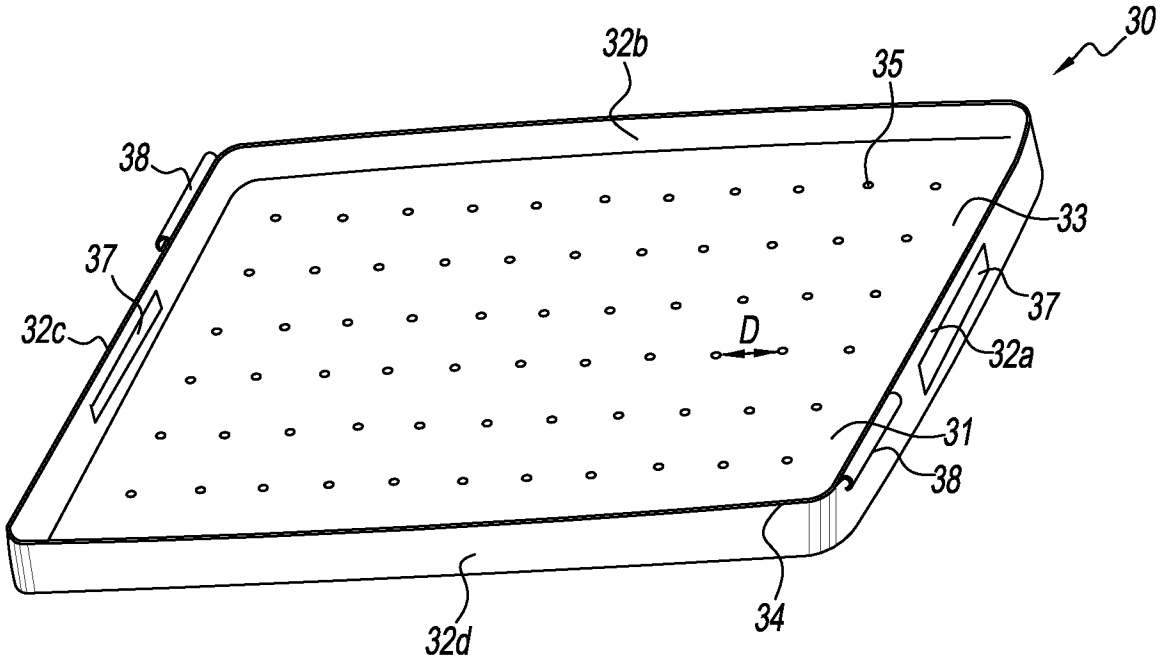
FIG. 3 is the removable tray of the cosmetic organizer.
Figure 10:
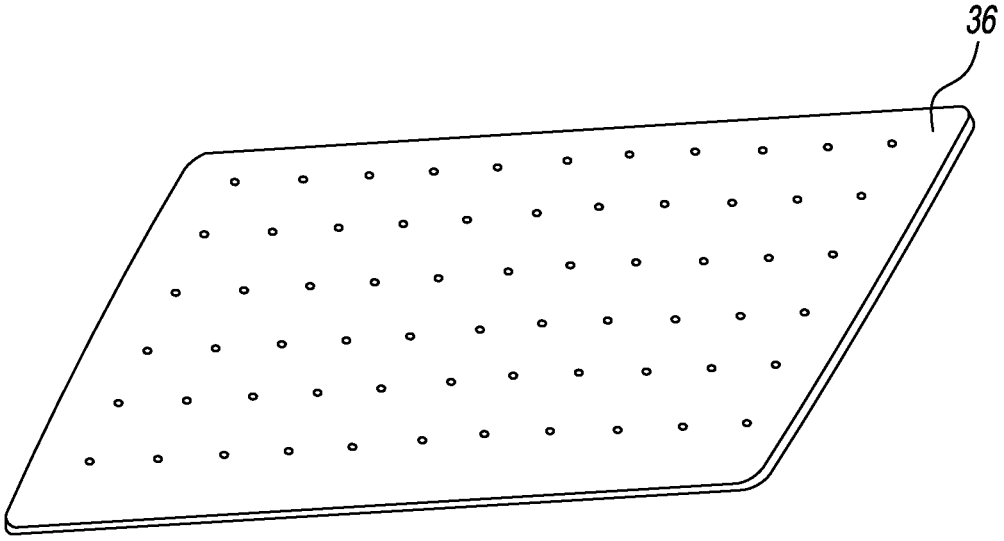
FIG. 10 shows a planar sheet with a grid of indents.

As shown in FIG. 3, the tray 30 has a planar portion 31 with four walls 32*a*, 32*b*, 32*c*, 32*d* extending upwardly from the perimeter of the planar portion 31, defining an internal area 33 surrounded by an edge 34. A handle element 37 may be provided on one or more of the four walls 32*a*, 32*b*, 32*c*, and 32*d*. Handle element 37 may be an opening on two or more walls 32*a*, 32*b*, 32*c*, and 32*d*. Handle element 37 may also be a rolled lip extension 38 on two or more walls 32*a*, 32*b*, 32*c*, and 32*d*. The handle element 37 or 38 may extend across either a portion of or along the entire width of the walls 32*a*, 32*b*, 32*c*, and 32*d*. Within the internal area 33 of the planar portion 31 is a grid of indents 35 that are evenly spaced apart from each other. Similar to the housing 10, tray 30 may be made of a soft or hard material, as long as it provides a certain degree of sturdiness to serve the purposes to be described below. Each indent 35 may be hemispherical, a cylindrical cavity, or any other shape and can be of different sizes. Indent 35 may also be a through aperture. Instead of having a grid of indents 35 on the planar portion 31 that is integral with the tray 30, a grid of indents 35 may be on a separate, removable, planar sheet of material 36 (as shown in FIG. 10) that can be placed on top of the planar portion 31 within the internal area 33. Tray 30 is stored in the main storage compartment 14 of the housing 10 when the cosmetic organizer 100 is closed and not in use. Tray 30 may also rest in the main storage compartment 14 of the housing 10 when the cosmetic organizer 100 is in an open position and being used (tray 30 of FIG. 8 when in use can be placed within compartment 14 of FIG. 2).

Figure 5:
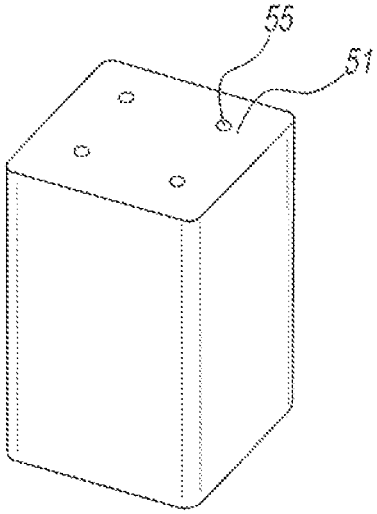
FIG. 5 is a bottom perspective view of the modular box shown in FIG. 4A.
Figure 8:
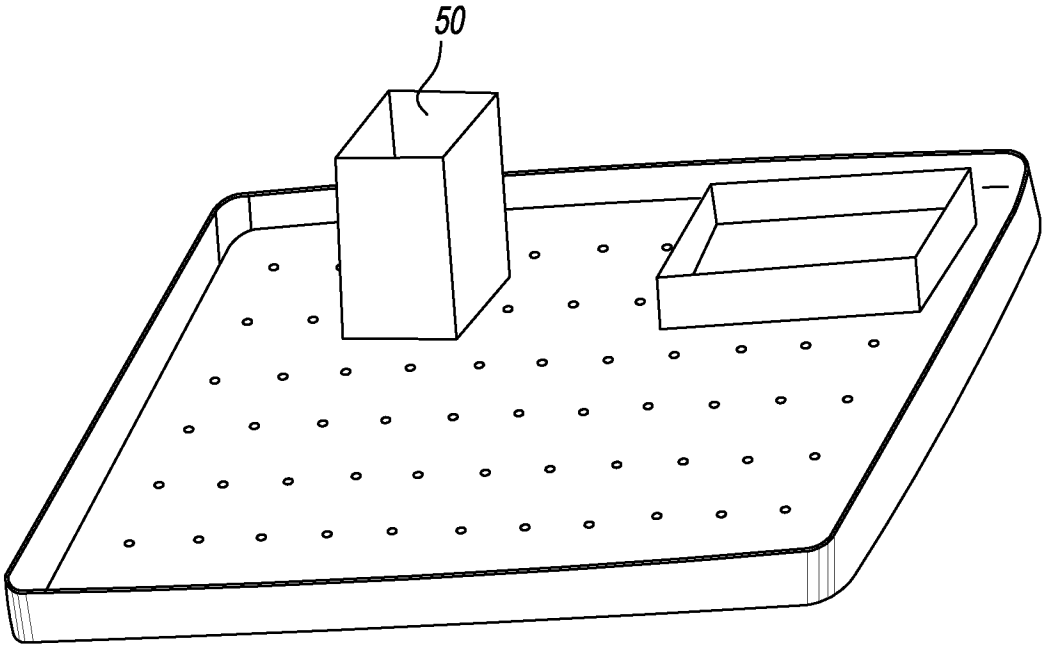
FIG. 8 shows the present invention when in use, with the removable tray and two modular boxes.

As shown in FIGS. 4A-4I, each modular box 50 has a support base 51 with four panels 52*a*, 52*b*, 52*c*, 52*d* extending upwardly from the first side of the support base 51 defining a storage area 53. As shown in FIG. 5, at the second side of the support base 51 are four protrusions 55. Each protrusion 55 is shaped to generally correspond to the shape of the indent 35 and it may be hemispherical, cylindrical, or any other shape. The spacing of the protrusion 55 corresponds to the grid of indents 35 on the planar portion 31 of the tray 30 such that each modular box 50 sits securely in a defined position within the internal area 33 of tray 30 within the edge 34 as shown in FIG. 8. The second side of the support base 51 of the modular box 50 may abut the planar portion 31 of the tray 30 to ensure that it sits securely in the defined position, which is enhanced when the indents 35 are through apertures.

Modular boxes 50 shown in FIGS. 4A-4I have different shapes and sizes support base 51 such as square and rectangle. However, different size and shape (such as circular, oval, irregular, etc.) support base 51 can also be used. Modular boxes 50 shown in FIGS. 4A-4I also have different panel heights. Depending on the size of the modular box 50, more protrusions 55 may be provided to position the modular box 50 within the internal area 33 of tray 30. Different modular boxes 50 of FIGS. 4A-4I are used to accommodate and store different sizes and shapes of cosmetic items. If the distance between adjacent indents 35 is D (as shown in FIG. 3), then the size of the support base 51 of the modular boxes 50 may be mD×nD, where m and n are whole numbers to allow adjacent modular boxes 50 to abut each other. For example, the modular box 50 shown in FIG. 5 would have a dimension of 2D×2D.

Modular boxes 50 can be folded or collapsed into a flat planar configuration for storage within the housing 10 when not in use. Modular box 50 of FIG. 4G shows that opposing panels 52*b* and 52*d* have crease lines 54 that allow opposing panels 52*a* and 52*c* to be folded into the storage area 53 on top of the support base 51 as shown by directional arrows A. In another embodiment, modular box 50 of FIG. 4I shows that opposing panels 52*a* and 52*c* have crease lines 56 that allow opposing panels 52*b* and 52*d* to be folded into the storage area 53 on top of the support base 51 as shown by directional arrows B.

Figure 6:
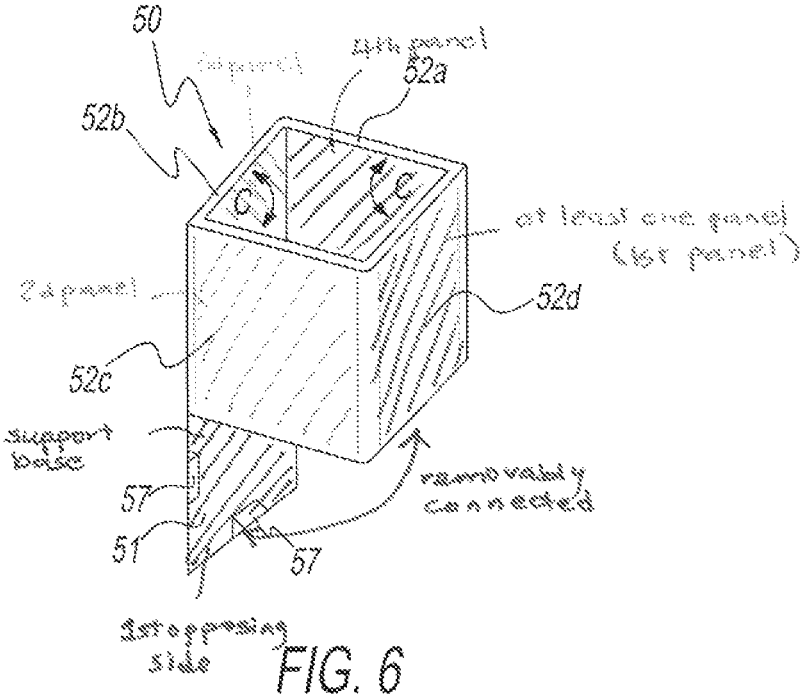
FIG. 6 illustrates one embodiment of a collapsible modular box of FIG. 4A.

FIG. 6 shows the modular box 50 of FIG. 4A with a support base 51 having one edge connected to a panel 52*b*. Panels 52*a*, 52*b*, 52*c* and 52*d* are pivotably connected to each other. Along at least one edge not connected to panel 52*b* of the support base 51 is at least one latch 57 for engaging one or more of the remaining panels 52*a*, 52*c* and 52*d* to form modular box 50. When latches 57 are disengaged, the panels 52*a* and 52*b* may be folded to face panels 52*d* and 52*c*, respectively, and as shown by directional arrows C, for storage within the housing 10.

Figure 7:
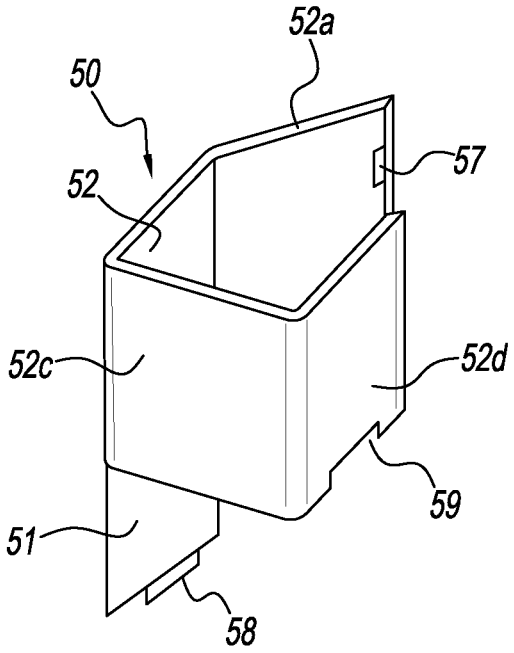
FIG. 7 illustrates another embodiment of a collapsible modular box of FIG. 4A.

FIG. 7 shows the modular box 50 of FIG. 4A with a support base 51 having one edge connected to a panel 52*b*. Panels 52*a* and 52*b* are pivotably connected to each other, panels 52*b* and 52*c* are pivotably connected to each other, and panels 52*c* and 52*d* are pivotably connected to each other. Panel 52*a* has a latch 57 for engaging panel 52*d* to form modular box 50. Along at least one edge not connected to panel 52*b* of the support base 51 is at least one tab extension 58 for engaging corresponding cutout(s) 59 on one or more of the remaining panels, such as panel 52*d*, to form modular box 50. In this configuration, all the panels 52*a*, 52*b*, 52*c* and 52*d* and support base 51 can be completely unfolded for storage within the housing 10.

Figure 12:
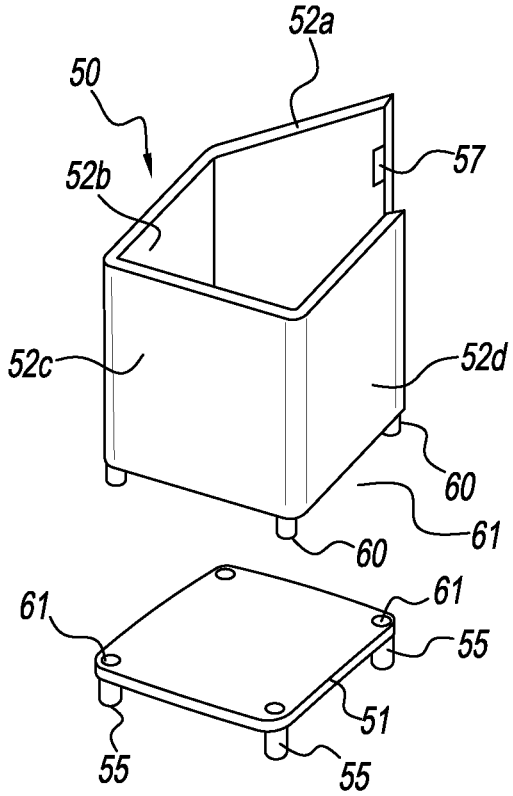
FIG. 12 illustrates another embodiment of a collapsible modular box of FIG. 4A.

FIG. 12 shows the modular box 50 of FIG. 4A with a support base 51 that is removably detachable from panels 52*a*, 52*b*, 52*c*, and 52*d*. Extending from the junction between each pair of panels 52*a*, 52*b*, 52*c*, and 52*d* is a leg 60. On the first side (upper surface) of the support base 51 are four cavities 61 that are sized to frictionally and securely receive legs 60. Extending from the second side (lower surface) of the support base 51 is a plurality of protrusions 55 for positioning modular box 50 on the grid of indents 35. While panels 52*a*, 52*b*, 52*c* and 52*d* are shown to be connected to each other, they can also be individual panels that are removably connected to each other by Velcro®, friction, latch and hook, hinges, etc., as shown in FIG. 13.

Figure 13:
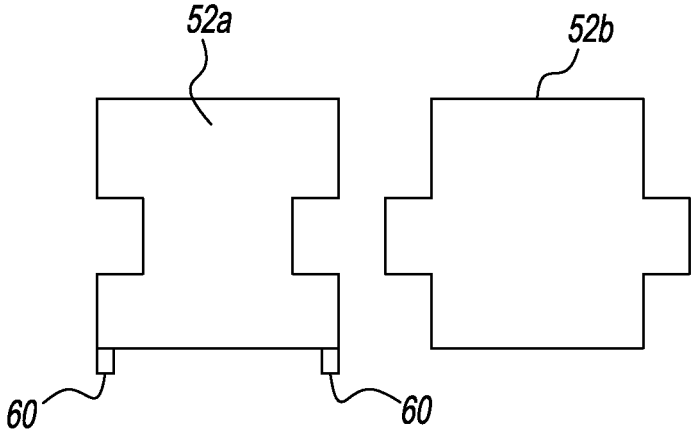
FIG. 13 illustrates panels of another embodiment of a collapsible modular box of FIG. 4A.

The panels 52*a*, 52*b*, 52*c* and 52*d* and support base 51 can be selectively disconnected and engageable to each other with various fastening elements or configurations such as the latch 57 shown in FIG. 6 or the tab extension 58 and cutout 59 shown in FIG. 7 or the individual panels 52*a*, 52*b*, 52*c* and 52*d* shown in FIG. 13, or other configurations known to one skilled in the art, such as Velcro®, hook and slot, etc. The modular box 50 is preferably made of a light-weight, stiff material, to support its own structure and to be able to hold cosmetic items therein. For example, it can be made of cardboard or cardstock, whether laminated or not, or plastic boards. However, other material known to one skilled in the art can also be used for the modular box 50.

Figure 9:
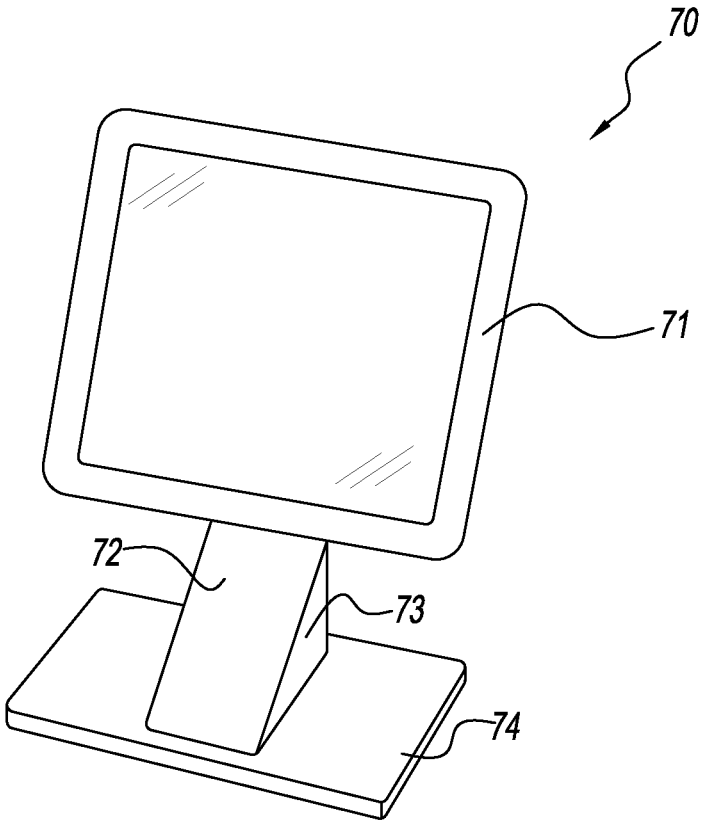
FIG. 9 is a collapsible mirror for use with the cosmetic organizer.

FIG. 9 shows a mirror 70 having an upper frame 71, a support arm 72, support wings 73 and a pedestal 74. Upper frame 71 with a reflective surface is connected to and supported by support arm 72, which is pivotably and foldably connected to and supported by pedestal 74. A pair of support wings 73 pivotably and foldably extends from each side of the support arm 72 and is removably engageable to pedestal 74, which may have slots for receiving the support wings 73. With the pivotable/foldable connection between the support arm 72 and support wings 73 and the support arm 72 and pedestal 74, mirror 70 can be collapsed to a flat planar configuration for storage within the housing 10 when not in use.

Figure 14:
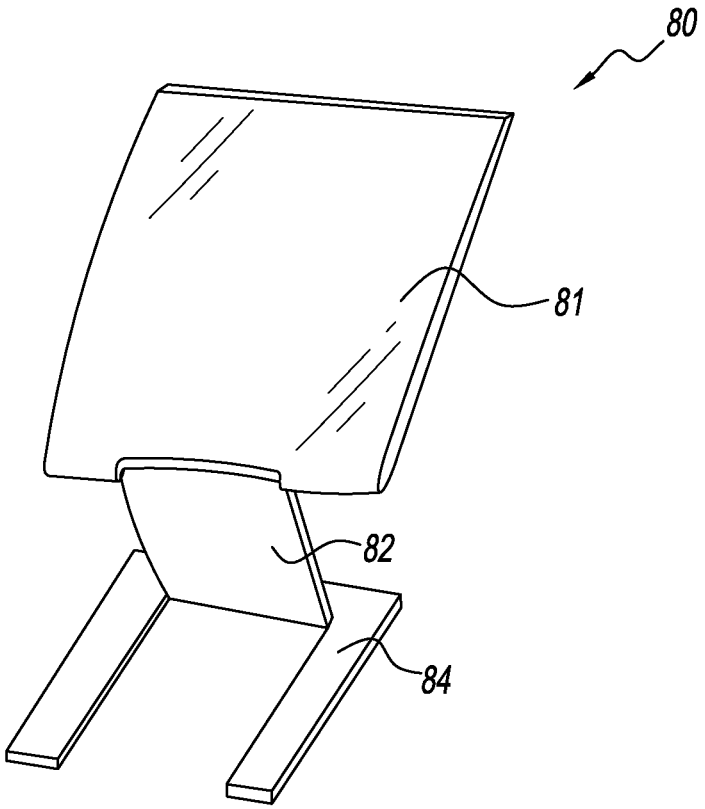
FIG. 14 is another embodiment of a collapsible mirror for use with the cosmetic organizer.

FIG. 14 shows another mirror 80 for use with the present invention. Mirror 80 has an upper reflective surface 81, a support arm 82 and a pedestal 84. Reflective mirror 81 is connected to and supported by support arm 82, which is pivotably and foldably connected to and supported by pedestal 84. With the pivotable/foldable connections between the support arm 82 and pedestal 84, and between the support arm 82 and the reflective surface 81, with the support arm 82 configured to fit between and lay flat adjacent the pedestal 84, mirror 80 can be collapsed to a flat planar configuration for storage within the housing 10 when not in use. Other foldable configurations for the mirrors 70 and 80 known to one skilled in the art can also be used. The reflective surfaces of mirror 70 and 80 may be a regular mirror or a magnified mirror or having different portions with different magnification (e.g. 3× magnification on the lower half and 5× magnification on the upper half).

One or more folded modular boxes 50 may be stored and provided within the housing 10 as part of the cosmetic organizer 100 and packaged and sold as one unit. Additional modular boxes 50 may be packaged and sold separately and independently from the cosmetic organizer 100. Modular boxes 50 and mirror 70 or 80 may be stored folded within the tray 30 or in one of the compartments 14, 15, 17*a*, 17*b* of the housing 10.

To use the cosmetic organizer 100 of the present invention, a user can first remove the tray 30, folded modular boxes 50, and folded mirror 70 or 80 from the housing 10. Second, unfold or form the mirror 70 or 80 and the modular boxes 50 and set the modular boxes 50 on the tray 30. Third, remove any cosmetics items stored in the housing 10 and sort and organize them into the different modular boxes 50. The user can now easily access the cosmetics with the present invention. The reverse steps can be taken to easily transport the cosmetic organizer and its contents.

Figure 11A:
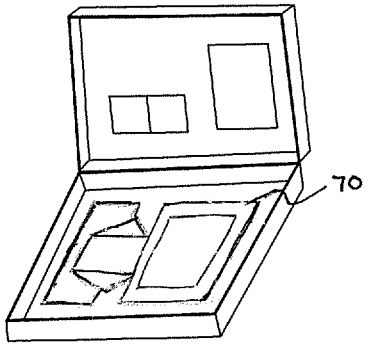
FIGS. 11A-11C show various shapes of the housing and the tray.
Figure 11B:
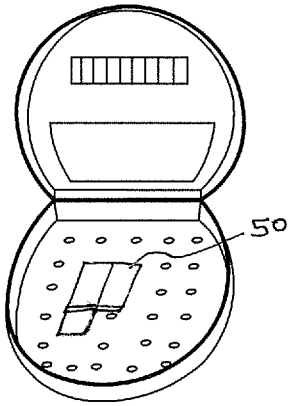
Figure 11C:
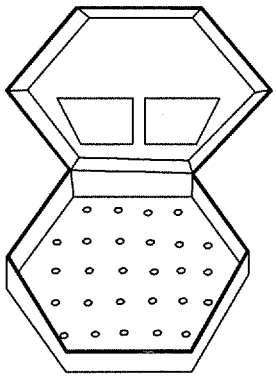

The shapes of the housing 10 and tray 30 are not limited to rectangle as shown, but can be square, circle, oval, and other shapes, such as those shown in FIGS. 11A-11C.

The features of the invention illustrated and described herein are the preferred embodiments. Therefore, it is understood that the specification is intended to cover unforeseeable embodiments with insubstantial differences that are within the spirit of the specification.

What I claim is:

1. A portable modular cosmetic storage system, comprising:

a housing having a base and a cover connected to said base, said base defining a first storage compartment;

at least one tray having a planar portion and a plurality of walls having a first height extending upwardly from said planar portion thereby defining an internal area, said tray having a grid of indents on said planar portion and wherein said tray is removably housed in said first storage compartment; and at least one modular collapsible box, each modular collapsible box having a support base having a first top side and an opposing second bottom side with said first top side having a first edge and an opposing second edge; and at least first, second, third, and fourths panel pivotally interconnected to each other and to the support base, each of said panels being rectangular and having an upper edge, an opposing lower edge, a first side edge, and an opposing second side edge; wherein said panels are interconnected to each other such that said second edge of said second panel is pivotally connected to said first side edge of said first panel, said first side edge of said second panel is pivotally connected to said first side edge of said third panel, said second side edge of said third panel is pivotally connected to said second side edge of said fourth panel, and said second side edge of said first panel is pivotally connected to said first side edge of said fourth panel, and said lower edge of said first panel is detachably connected to said first edge of said first top side of said support base, with a plurality of protrusions extending downwardly from said second bottom side of said support base so as to cooperatively engage said grid of indents of said tray when said modular collapsible box is stored in said tray;

wherein a distance between the upper edge of each of said panels, that form said modular box, and said lower edge of each of said panels, that form said modular box, define a second height greater than said first height;

wherein when said at least one modular collapsible box is in a collapsed position such that said box is in a flat planar folded configuration with said panels and said support base forming a plane, it is stored along with said tray in said housing within said first storage compartment with said housing in a closed position defined as the cover joined to the base.

2. The system of claim 1, wherein said lower edge of said third panel is pivotally connected to said second edge of said support base.

3. The system of claim 1 wherein said second side edge of said first panel and said first side edge of said fourth panel are detachably connected to each other with a fastening element.

4. The system of claim 3, wherein said fastening element is a latch on said second side edge of said first panel for removable connection with said first side edge of said fourth panel.

5. The system of claim 1, wherein each of said first, second, third, and fourth panels has at least one leg extending from said respective lower edge of each of said panels, and said first top side of said support base has a cavity for receiving each of said leg.

6. The system of claim 1 wherein said base and said cover are connected to each other with at least one zipper.

7. The system of claim 1 wherein said cover has at least one second storage compartment.

8. The system of claim 1 wherein said housing is made of a soft and flexible material.

9. The system of claim 1 wherein said tray has a handle element on at least one of said plurality of walls.

10. The system of claim 9 wherein said handle element comprises at least one opening.

11. The system of claim 9 wherein said handle element comprises at least one rolled lip extension.

12. The system of claim 1 wherein said grid of indents are evenly spaced apart.

13. The system of claim 1 wherein said grid of indents is a grid of through apertures.

* * * * *